United States Patent [19]

Focke et al.

[11] Patent Number: 4,617,780

[45] Date of Patent: Oct. 21, 1986

[54] METHOD AND APPARATUS FOR WRAPPING CIGARETTE PACKETS IN FILM BLANKS

[75] Inventors: Heinz Focke; Kurt Liedtke, both of Verden, Fed. Rep. of Germany

[73] Assignee: Focke & Co. (GmbH & Co.), Verden, Fed. Rep. of Germany

[21] Appl. No.: 645,187

[22] Filed: Aug. 29, 1984

[30] Foreign Application Priority Data

Sep. 13, 1983 [DE] Fed. Rep. of Germany ..... 3332950

[51] Int. Cl.[4] ..... B65B 11/00

[52] U.S. Cl. ..... 53/466; 53/202; 53/228; 53/234

[58] Field of Search ..... 53/225, 228, 232–234, 53/466, 586, 202

[56] References Cited

U.S. PATENT DOCUMENTS 3,760,559 9/1973 Heinzer ..... 53/546
4,092,816 6/1978 Seragnoli ..... 53/234
4,352,264 10/1982 Seragnoli ..... 53/234 X
4,367,618 1/1983 Focke ..... 53/234
4,495,745 1/1985 Crescenzo et al. ..... 53/234 X

*Primary Examiner*—John Sipos
*Assistant Examiner*—Steven P. Weihrouch
*Attorney, Agent, or Firm*—Sughrue, Mion, Zinn, Macpeak & Seas

[57] ABSTRACT

For raising the rate of production of packaging machines, especially for the manufacture of cigarette packets (10, 11), the rate of production of an apparatus for wrapping the packets in an outer blank (film blank 19, 20) is to be raised. For this purpose a plurality, especially two adjacent packets (10, 11) are conveyed simultaneously, and are wrapped in a common overall blank (18) of corresponding width. After formation of a stable tubular blank, which wraps both the packets (10, 11), there follows the cutting through of the overall blank (18), with formation of the individual film blanks (19, 20) which thereafter are fully folded.

5 Claims, 7 Drawing Figures

METHOD AND APPARATUS FOR WRAPPING CIGARETTE PACKETS IN FILM BLANKS

DESCRIPTION

Figure 1:
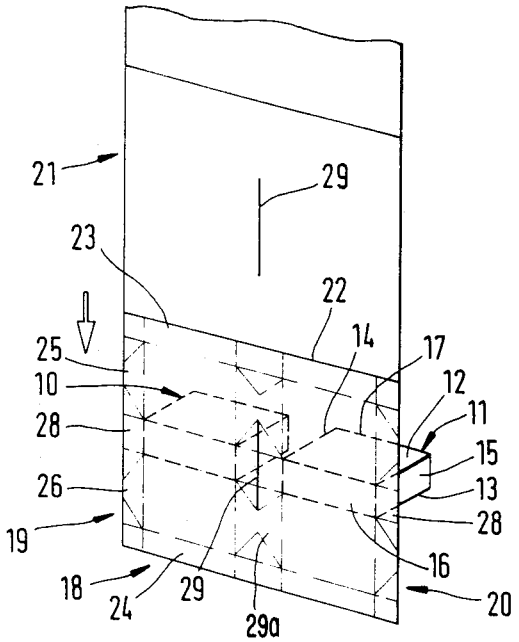

The invention relates to a method of wrapping articles in blanks, especially packets (cigarette packets) in film blanks, which are folded round in U-shape around the packets being conveyed relatively to them, and thereafter are fully folded. Furthermore the invention relates to an apparatus for performing the above-mentioned method.

Cigarette packets are predominantly provided with an outer wrapping, which consists of a regenerated cellulose film, or—recently—of a plastic film. During wrapping of the packet, the film blank is predominantly laid in a U-shape around the packet, starting from one longitudinal face of the (rectangular) packet, so that, in the area of the end faces and also of an opposite longitudinal face, parts of the blank project beyond the packet. As a consequence of movement relative to the packet, these parts are folded against the associated faces of the packet, by means of movable or stationary folding means. In the area of one longitudinal face, overlapping tube flaps of the film blank can be connected together at the same time, by welding or adhesive.

In the packing of cigarettes, extremely high cycle rates are achieved. Film-wrapping machines coupled to the packing machines are frequently no longer able to provide the finished cigarette packets with a film wrapper in a reliable manner, when the output of packets prepared is high.

The object of the invention is, accordingly, to raise the rate of production in the film-wrapping area, without disadvantages arising by mechanical stressing, as a consequence of the excessive conveying speeds of the delicate (cigarette) packets.

As a solution of the above-mentioned object, it is proposed according to the invention that at least two packets are conveyed simultaneously, with a transverse spacing between them, a common, correspondingly dimensioned overall blank is folded around the two packets, and thereafter the blank is cut through in the area between the packets.

According to the method according to the invention, handling is in multi-line operation, especially with two (cigarette) packets conveyed simultaneously and in the same transverse plane. The further feature lies in the fact that a common, correspondingly dimensioned overall blank is delivered to the packets lying adjacent to one another, and is folded in U-shape around the packets. The use of an overall blank for all the packets conveyed simultaneously has the advantage that the folding operations can occur faster and with more precision. The packets held together by the common overall blank constitute a unit which is easy to handle. Moreover a blank of the size of an overall blank is easier to handle with the usual extremely thin-walled material.

According to another proposal of the invention, after the U-shaped placing of the overall blank, a tubular blank of corresponding length is formed by over lapping of tube flaps along the periphery and connecting the latter together. There now exists a three dimensionally shaped overall blank, which can be cut through in the area between the packets held spaced apart, without the occurrence of relative displacements of the packets, or of the foil blanks now produced.

According to the invention, before the formation of the tubular blank, lateral end flaps of the overall blank, projecting from the longitudinal faces, and leading in the direction of movement, are folded round, that is to say against the associated end face of the packet, in fact by stationary folding means. This is also true for the lateral end flaps formed in the area between the packets conveyed adjacent to each other. For this purpose, according to the invention, the overall blank, or a web of material for formation of the blanks, is provided at appropriate places with a preliminary cut, which extends in the longitudinal direction of the web of material, i.e. in the direction of movement of the overall blank, about in the middle of the latter, and separates from one another the lateral end flaps which have to be folded there.

In this way it is possible to insert the simultaneously conveyed packets, lying adjacent to one another, together with the overall blank, into a revolving conveyor, especially into the pockets of a turret, while, during the loading movement, the lateral end flaps lying foremost in the conveying direction are folded round in the described manner, by folding fingers arranged on the turret.

The apparatus according to the invention, for wrapping cigarette packets in film blanks, is accordingly provided with a revolving conveyor, especially a turret, which has pockets opening outwards radially, these pockets being dimensioned transversely to the conveying direction corresponding to the number of packets. Folding fingers, fixed at the pockets of the turret, are arranged on the outside of the pockets and centrally or at a distance corresponding to the spacing of the packets from one another.

Furthermore, according to the invention a separating knife is associated with the turret, especially a rotatably driven disc knife, which extends into a narrow rotating knife slot of the turret and divides the (tubular) overall blank in the region of a separating station.

Further details of the invention relate to the construction of the (overall) blank, the device for preparation of the latter, i.e. for pretreatment of the web of material, to the construction of the turret, and the associated conveying and folding means.

Figure 2:
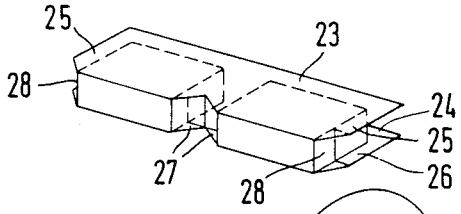
Figure 4:
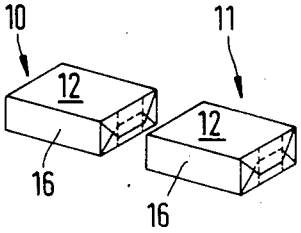
Figure 3:
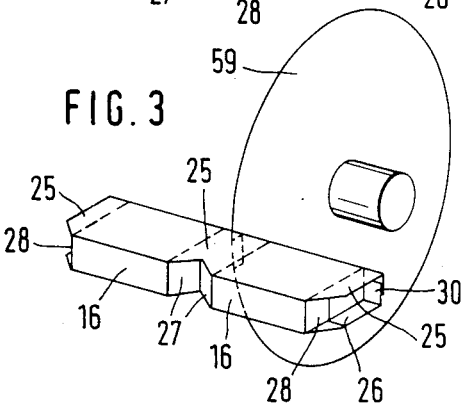
Figure 5:
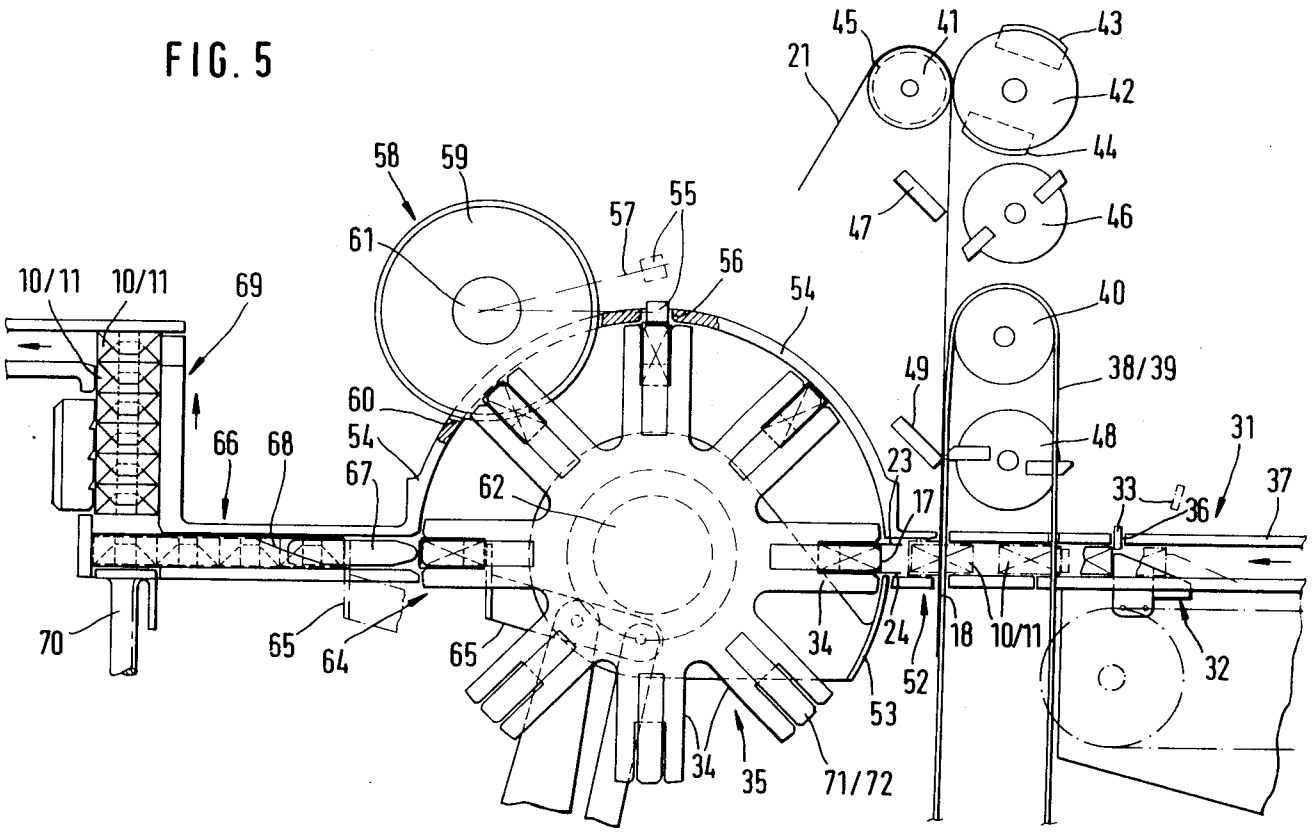
Figure 6:
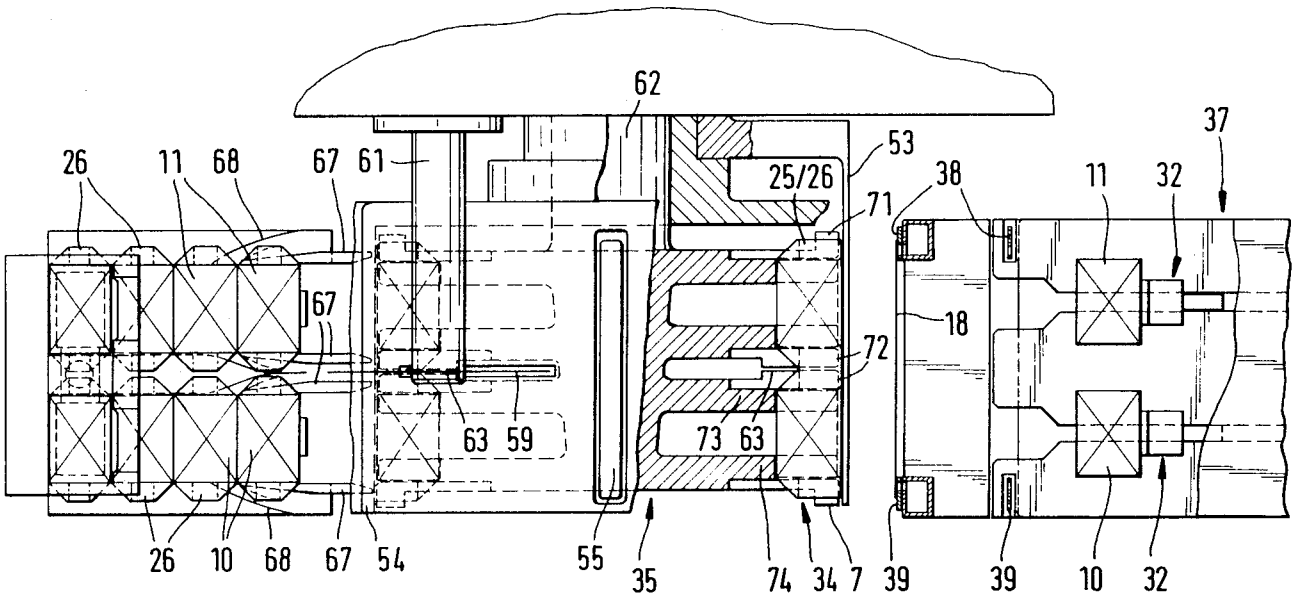
Figure 7:
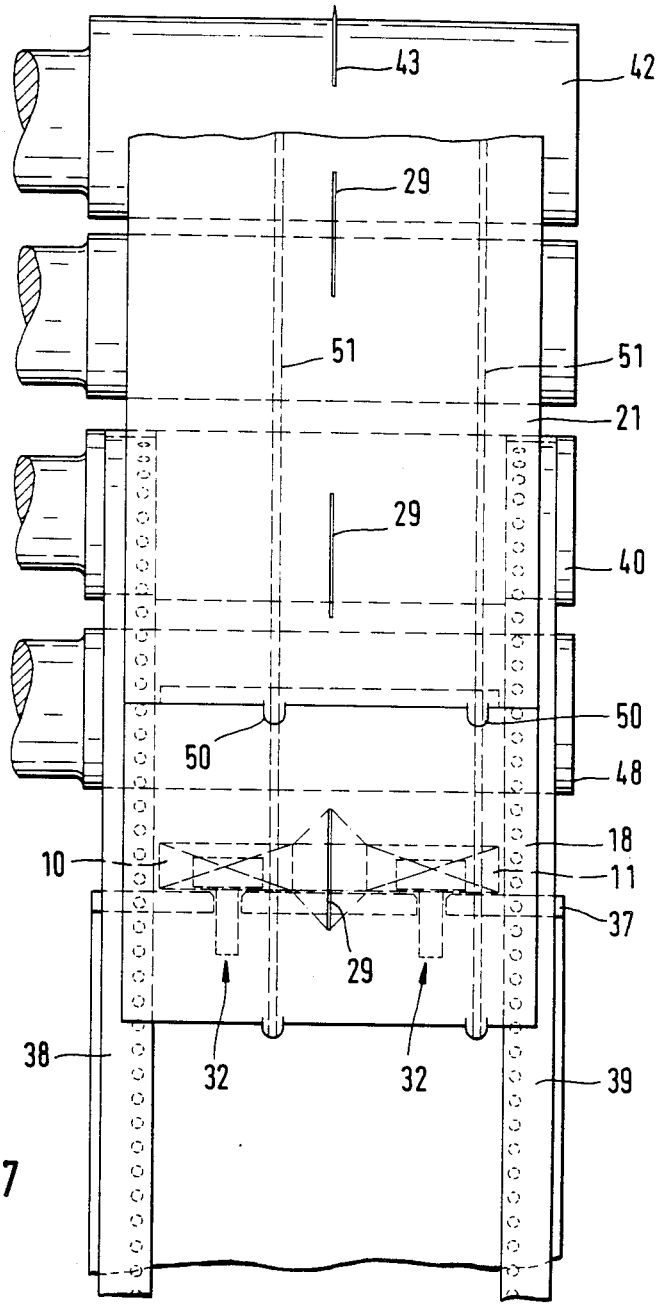

The method and the apparatus are described more fully below, with reference to the drawings, in which FIG. 1 shows a portion of a vertically conveyed web of material with two packets to be wrapped, in perspective view, FIG. 2 shows two packets after partial wrapping by an overall blank, likewise in perspective view, FIG. 3 shows a phase during the manufacture of the individual blanks for each packet by a dividing knife, FIG. 4 shows two packets, conveyed adjacent to one another, each wrapped in a film blank, FIG. 5 shows an apparatus for manufacture of packets according to FIGS. 1 to 4, in schematic side elevation, FIG. 6 shows the apparatus according to FIG. 5, in plan, FIG. 7 shows a front elevation of the apparatus in the region of a vertical conveyor.

The embodiment shown relates to the wrapping of rectangular packets 10, 11, especially cigarette packets, in a blank of a plastic film or of regenerated cellulose film. The packets 10, 11 are defined by a front face 12 and rear face 13, by end faces 14 and 15, and also by longitudinal faces 16 and 17.

One feature lies in the fact that several, namely two, packets 10 and 11, arranged with a spacing from one another, are aligned in the transverse direction, and are conveyed with a spacing from one another, and are wrapped in common in a correspondingly dimensioned overall blank 18. This is separated from a continuous web 21 of material by a transverse separating cut 22, in double the width of an individual film blank 19 or 20 for one packet 10, 11 each. The overall blank 18 is then bent round the two packets 10, 11 in a U-shape (FIG. 2), in such a way that, at the rear face (longitudinal faces 17) related to the direction of travel, upper and lower tube flaps 23, 24 project. Laterally, i.e. at right angles to the direction of conveying, upper and lower longitudinal face flaps 25 and 26 project over the end faces 14, 15. As prolongation of the longitudinal faces 16 directed forwards, lateral end flaps 27 and 28 are formed by the overall blank 18.

By travel of the packets 10, 11 with the overall blank 18 relative to corresponding folding means, firstly the lateral end flaps 27 and 28 for each packet are folded onto their end face 14, 15. The lateral end flaps 27 which face each other, i.e. are central, are likewise folded over. This is made possible by the fact that the overall blank 18 has a previously applied preliminary cut 29 in the area of the future lateral end flaps 27. This preliminary cut lies centrally between the packets 10, 11 in the region of a material strip 20*a* of double the width of a lateral end flap 27. In the present embodiment, the preliminary cut 29 has already been made in the material web 21 at a predetermined place. Because of the length of the preliminary cut 29, it is also possible to fold the lateral end flaps 27 against the facing end faces 14, 15 of the packets 10, 11 while maintaining the integrity of the overall blank 18.

Then a tubular blank is made by folding over and partly overlapping the tube flaps 23, 24 and also by connecting the latter (FIG. 3). What happens next is the severing of the overall blank 18 in the area between the packets 10, 11, namely as an extension of the preliminary cut 29. The flaps which are still extending beyond the end faces 14, 15, namely longitudinal end flaps 25 and 26, and also lateral end flaps 30 on the rear face, are folded in the usual way against the end faces 14, 15, so that the folded condition of the packets 10, 11 is attained, as visible from FIG. 4.

In the embodiment shown of the apparatus, the packets 10, 11 (in pairs) lying adjacent to each other on a common conveyor track 31 are supplied in sequence. A rotary conveyor (chain conveyor 32) serves first for moving the packets 10, 11 on the horizontal conveyor track 31. From this, the packets 10, 11 are taken over by a pusher 33, which dips from above into the path of movement of the packets 10, 11, and moves the packets 10, 11 further by engagement of the rear face (longitudinal faces 17), up to reception in a pocket 34 of a turret 35. After transference of the packets 10, 11 to the turret 35, the pusher 33 is moved outwards and returns to the starting position above the conveyor track 31, as shown in broken lines. The entry into this track occurs via an opening 36 in an upper guide 37 of the conveyor track 31.

The overall blank 18 is delivered transversely to the direction of conveying of the packets 10, 11, in the present case in a vertical plane, from above downwards. The movement of the overall blank 18 in the area to either side of the conveyor track 31 occurs by means of conveyor belts subjected to vacuum, namely two perforated belts 38 and 39 running at a spacing from one another. The construction of these, as well as the installation for subjecting the perforated belts 38, 39 to vacuum, can take place in a suitable way, particularly in the embodiment in German Offenlegungsschrift No. 2,530,992. The perforated belts 38, 39 are led over an upper return roller 40 and a corresponding lower return roller, not shown, below the conveyor track 31.

The web 21 of material is delivered to the film conveyors described above, namely the perforated belts 38, 39, via tension rollers 41, 42. These have at the same time the object of inserting the preliminary cut 29 at a suitable place within the web of material 21. For this purpose the tension roller 42 of larger diameter is equipped with knife segments 43 and 44, which project beyond the bounding surface of the tension roller 42, and make the preliminary cut of corresponding length in the web 21 of material. During one revolution of the tension roller 42, two preliminary cuts 29 are made accordingly, i.e. two overall blanks 18 are correspondingly prepared. During the simultaneous wrapping of two packets 10, 11, the knife segments 43, 44 are arranged centrally on the tension roller 42. The opposite, smaller tension roller 41 is provided with a circumferential incision 45 in the same plane, hence likewise centrally in the present case, into which the knife segments 43, 44 enter during the making of the preliminary cut 29.

A further separating device, namely a knife roller 46 with a fixed counter-knife 47, is arranged preceding the return roller 40 and above the latter. By this separating arrangement, a (transversely directed) partial cut is made in the web 21 of material, indeed substantially in the area of the perforated belts which thereafter grip the web 21 of material. A main cut, joining onto the partial cuts for completion of the transverse separating cut 22, is produced by a further knife roller 48 and counter-knife 49, in the area of the perforated belts 38, 39 and lying between them. The method of cutting through a web 21 of material by a plurality of partial cuts following one another is carried out according to the features of German Offenlegungsschrift No. 2,530,992. Together with the transverse separating cut 22, a U-shaped separating cut is made, for production of two grip tongues 50, each in the area of a tear strip 51 applied to the web 21 of material. The tear strips 51 are so applied, that they run in the usual way, within the wrapping of the completed packets 10, 11, off-centre, namely directed towards one of the end faces.

The overall blanks 18, thus separated and prepared, are seized in the area of a mouthpiece 52 by two packets 10, 11, conveyed simultaneously at a spacing from one another, and are conveyed through the mouthpiece 52, into a pocket 34 of the turret 35 held ready directly adjacent to the mouthpiece 52. During this, the overall blank 18 lies in a U-shape in the described manner around the packets 10, 11. The pocket 34 is so dimensioned in the radial direction that the packets 10, 11, by the rearward, i.e. outer, longitudinal face 17, close off the pocket, substantially flush with the outer boundary of the pocket 34. Accordingly, tube flaps 23, 24 projecting rearwards extend outwards from the pocket 34.

As the next step, the above-mentioned tube flaps 23 and 24 are now folded against the associated longitudinal face 17, namely first the lower tube flap 24. For this purpose, a folding means 53 constituted as an arc-shaped plate is moved in the circumferential direction of the turret 35 and concentrically to it—in the illustration in FIG. 5 in the upward direction. The lower tube flap 24 is thereby folded round against the longitudinal face 17, and is fixed in this position until further anticlockwise conveying movement of the turret. The arcuate folding means 53 is accordingly moved to and fro in the circumferential direction for performing the foldings.

By the further shifting of the turret 35, the pocket 34 with the introduced packets 10, 11 arrives in the area of a stationary guide wall 54 pressed close to the circumference of the turret 35. The guide wall 54 merges with the upper part of the mouthpiece 52.

As soon as the pocket 34 arrives in the area of the guide wall 54, by further rotation of the turret 35, the upper tube flap 23 is folded round against the longitudinal face 17 of the packets 10, 11, i.e. against the previously folded tube flap 24. In this way the tubular blank is produced.

The tube flaps 23, 24, partly overlapping one another, are connected together by pressure and application of heat, in the area of a sealing station, by a sealing tool in the form of a sealing strip 55. The sealing strip is guided down from the outside onto the longitudinal face 17, i.e. onto the tube flaps 23, 24, while the sealing strip 55 passes through a slit-shaped opening 56 in the guide wall 54. In the present exemplary embodiment the sealing strip 55 is movable by a swinging arm 57 into the sealing position.

The preparation and stabilisation of the tubular blank, is followed by a separating station 58. In this the tubular blank is cut through centrally, i.e. in the centre between two adjacent packets 10, 11. For this purpose a rotatingly driven thin separating knife 59, in this case formed in disc shape, enters into the turret 35, through a knife slot 60 in the guide wall 54. A driving shaft 61 for the separating knife is arranged outside the turret, i.e. outside the guide wall 54, axially parallel to a turret shaft 62.

In the area of the pockets 34, the turret 35 itself is provided with a thin knife slot 63 running all round. This enables the penetration of the separating knife 59 with the necessary depth into the turret 35, so that the tubular blank can be fully cut through in the separation station 58.

In the area of a following ejection station 64, packets 10, 11 are then in the pocket 34 with individual film blanks 19, 20, separated from one another. The packets 10, 11, with the film blanks 19, 20, are ejected together by an ejector 65 which is movable in the radial direction in a suitable manner. An output track 66 connects with the turret 34. Side guides of the said track are equipped in known manner as folding means. The entry end of the output track 66, connecting with the turret 35, is provided laterally with a folding tongue 67. In each case this folds the lateral end flaps 30, which are still lying ahead upon ejection of the packets 10, 11 out of the turret 35, against the associated end faces 14 and 15. In further travel, namely by the movement within the output track 66, the lower longitudinal end flaps 26 are folded in the present case against the end faces 14, 15, namely by a stationary folding deflector 68.

Onto the output track 66, in the present case horizontal, there is connected an upwardly directed packing tower 69, into which the nearly-finished packets 10, 11 are pushed in succession from below by a rammer 70. Via the entry into the packing tower 69, the upper longitudinal end flap 25 is folded over against the end face 14, 15, by side walls of the said tower, giving completion of the packets 10, 11. Within the packing tower 69 the completed packets 10, 11 are thereupon conveyed further.

A feature lies in the fact that, upon pushing in of the packets 10, 11, the first lateral end flaps 27 and 28, lying forwards in the direction of movement, are folded by stationary folding means against the associated end faces 14, 15, although the unity of the overall blank still exists. For this purpose, the pockets 34 of the turret 35 are equipped with deflecting fingers 71 and 72. These folding means constitute the lateral boundaries of the pockets 34, while the folding fingers 72 extending in the radial direction in the centre of the said pockets are separated from one another by the knife slot 63. The pockets 34, which extend over the full breadth of the turret 35, which in this case spreads over two packets 10, 11, are accordingly divided by the middle folding fingers 72 into two partial pockets, each for reception of one packet 10, 11. Upon pushing of the packets 10, 11 into the pocket 34 thus constituted, the lateral end flaps 27, 28, lying forward in the direction of pushing in, are accordingly folded over at both sides by the folding fingers 71 and 72. In the area between the packets 10, 11, this folding operation is possible because of the preliminary cut 29, without leading to stresses or fold formation in the overall blank.

The pockets 34 of the turret 35 are usually, on grounds of saving of material, each formed by tongues 73 and 74 arranged in pairs, spaced from one another.

The apparatus described is not only suited for handling of two packets at a time. As is apparent, with corresponding formation of the pockets of a turret, and of the conveying and separating means, a plurality of packets can be handled in a line adjacent to one another, while in each case a common overall blank for all the packets can be used, or a plurality of overall blanks each gripping two packets.

We claim:

1. A method of wrapping packets (10, 11) in blanks which are first folded in a U-shape around the packets and thereafter completely folded around the packets to encase them in the blanks, each of said packets having front and rear faces (12, 13,) a pair of lateral end faces (14, 15) and a pair of longitudinal faces (16, 17), comprising the steps of:

simultaneously forwardly moving along a first path at least two packets lying adjacent to each other with a preselected space therebetween such that a lateral end face of one packet is spaced, in a direction perpendicular to said first path, from a lateral end face of an adjacent packet;

feeding, along a path in a plane perpendicular to said first path and to a position intersecting said first path, a common, overall blank (18) of sufficient size to wrap at least two adJacent packets;

moving said at least two adjacent packets against said blank to cause folding of said blank around said at least two adjacent packets such that the blank has a U-shaped portion extending in a first direction parallel to the lengths of the longitudinal faces of adjacent packets and across said space, and in a second direction rearwardly over and beyond the front and rear faces of adjacent packets to form upper and lower tube flap portions (23, 24);

prior to said last moving step, forming a preliminary cut (29) in the portion of the blank covering the space between two adjacent packets to define the edges of future inner lateral end flap portions (27) facing said space;

moving said common blank against stationary fingers to fold said inner lateral end flap portions (27) and outer lateral end flap portions (28) against said laterla end faces (14, 15), respectively;

then connecting said upper and lower tube flap portions together to form a tubular shaped blank; and then, cutting along said preliminary cut (29) in the remaining portion of the blank (18) covering the space between two adjacent packets to sever said common blank (18) and to form first and second tubular shaped blank sections surrounding respective packets, and then folding remaining longitudinal and lateral end flap portions (25, 26, 30) of the blank against the respective lateral end faces of each of said respective packets.

2. The method of claim 1, wherein said step of feeding a common overall blank (18) includes the step of providing a web (21) of blank material and cutting said common blank from said web.

3. Apparatus for wrapping packets (10, 11) in blanks which are first folded in a U-shape around the packets and thereafter completely folded around the packets to encase them in the blanks, each of said packets having front and rear faces (12, 13), a pair of lateral end faces (14, 15) and a pair of longitudinal faces (16, 17) comprising:

means for simulataneously forwardly conveying in a first direction at least tow adjacent packets separated from one another in a second direction perpendicular to said first direction by a preselected space;

means for placing a common blank (18) in a position which is perpendicular to, and forward of said adjacent packets in, the conveying direction of said adjacent packets such that movement of said adjacent packets against said common blank in the conveying direction causes said blank to form a U-shape fold around longitudinal faces of said adjacent packets, said common blank being sized to cover and extend beyond the longitudinal faces in the lengthwise direction thereof of adjacent packets and cover and extend beyond the front and rear faces of adjacent packets to form rearwardly extending upper and lower tube flap portions (23, 24) to thereby be of a size sufficient to wrap said at least two adjacent packets;

a turret conveyor (35) having a plurality pockets (34) each dimensioned to simultaneously receive said at least two adjacent packets;

pushing means for simultaneously pushing adjacent packets, together with a common blank (18), into a pocket of said coveyor turret;

cuttings means for forming a preliminary cut (29) in the common blank (18) before the common blank is moved into said position, said preliminary cut (29) defining the inner edges of future inner lateral end flap portions (27) which face each other across said space and which are to be folded against inner ones (14) of said lateral end faces of said packets;

first stationary folding finger means (71), movable into a pocket receiving said at least two adjacent packets, for folding outer lateral end flap portions (28) of the blank against the other (15) of the lateral end faces of each of the adjacent packets;

second stationary folding finger means (72) movable into the interior of a pocket receiving said at least two adjacent packets, and located to intersect said space between said adjacent packets, said second stationary folding finger means effecting folding of said inner lateral end flap portions (27) of the common blank towards said ones (14) of the lateral end faces of adjacent packets which face each other across said space; and means for connecting the upper and lower tube flap portions (23, 24) of a common blank together after the blank is in a pocket to thereby form a tubular shaped common blank surrounding adjacent packets in a conveyor pocket; and means for cutting along said preliminary cut (29) in the remaining portion of the common blank (18) covering the space between two adjacent packets to sever said tubular shaped common blank into first and second tubular blank sections ench encasing only one packet; and means for folding remaining longitudinal and lateral end flap portions (25, 26, 30) of the blank against said lateral end faces (14, 15).

4. The apparatus claimed in claim 3, wherein said connecting means includes sealing means (55) for sealing the tube flap portions together.

5. The apparatus claimed in claim 3, further including means for supplying a web of film material and cutting means (46, 47, 48, 49) for cutting said web into common blanks (18).

* * * * *